US009004820B2

(12) United States Patent
Wang et al.

(10) Patent No.: US 9,004,820 B2
(45) Date of Patent: Apr. 14, 2015

(54) GROUTING METHOD FOR ANCHORING WITH POLYMER

(71) Applicant: Henan Polytech Infrastructure Rehabilitation Ltd., Zhengzhou,Henan (CN)

(72) Inventors: Fuming Wang, Henan (CN); Mingsheng Shi, Henan (CN); Chengchao Guo, Henan (CN); Hongliang Chen, Henan (CN); Dongkai Zhao, Henan (CN); Leiying He, Henan (CN)

(73) Assignee: SAFEKEY Engineering Technology(Zhengzhou), Ltd., Zhengzhou, Henan Province (CN)

( * ) Notice: Subject to any disclaimer, the term of this patent is extended or adjusted under 35 U.S.C. 154(b) by 0 days.

(21) Appl. No.: 13/866,024

(22) Filed: Apr. 19, 2013

(65) Prior Publication Data

US 2014/0314503 A1 Oct. 23, 2014

(30) Foreign Application Priority Data

Apr. 11, 2013 (CN) ..... 2013 1 0123668

(51) Int. Cl.
*E21D 20/02* (2006.01)
*E21D 21/00* (2006.01)
*E21D 20/00* (2006.01)

(52) U.S. Cl.
CPC ..... *E21D 21/00* (2013.01); *E21D 20/003* (2013.01); *E21D 20/025* (2013.01)

(58) Field of Classification Search
CPC ..... E21D 20/003; E21D 20/025
USPC ..... 405/259.5, 259.1
See application file for complete search history.

(56) References Cited

U.S. PATENT DOCUMENTS

| | | | | | |
|---|---|---|---|---|---|
| 4,126,009 | A | * | 11/1978 | Tomic | 405/259.5 |
| 4,247,223 | A | * | 1/1981 | Amakasu et al. | 405/259.5 |
| 4,397,589 | A | * | 8/1983 | Darroussin et al. | 405/259.5 |
| 4,413,929 | A | * | 11/1983 | Kigawa et al. | 405/259.5 |
| 4,648,753 | A | * | 3/1987 | Stephan | 405/259.5 |
| 4,765,778 | A | * | 8/1988 | Valentine | 405/259.5 |
| 4,830,544 | A | * | 5/1989 | Anderson, Jr. | 405/259.5 |

FOREIGN PATENT DOCUMENTS

| | | | | | |
|---|---|---|---|---|---|
| JP | 06248644 | A | * | 9/1994 | E02D 5/80 |

* cited by examiner

*Primary Examiner* — Frederick L Lagman

(57) ABSTRACT

A grouting method for anchoring with polymer is provided, wherein the method includes steps of: a) rod body processing; b) tying up a geotextile bag and grouting tubes on the anchoring rod body; c) hole drilling; d) polymer grouting: I. hole sealing grouting; II. anchoring grouting. The present invention has advantages of a sufficient adaptability, non-water reaction, convenient and fast construction, being economic, a high strength and a high durability. An expansive polymer material has an obvious compacting effect on soil, and is capable of increasing a friction force between a grout and a base; the water-proofing polymer material is an impermeable material for a steel rod body, and is of benefit to anti-corrosion and durability of the rod body; a solidifying time of the polymer material is short and no maintenance is needed in such a manner that construction periods are shortened.

1 Claim, 3 Drawing Sheets

GROUTING METHOD FOR ANCHORING WITH POLYMER

BACKGROUND OF THE PRESENT INVENTION

1. Field of Invention

The present invention relates to a technology field of reinforcing base facilities such as tunnels, foundations and side slopes, and more particularly to a method for grouting a polymer supporting anchor rod utilized in foundation pits, tunnels, side slopes, etc.

2. Description of Related Arts

In China, the development of the geotechnical anchorage technology began in late 50's of the 20th century, and at that time, the technology was mainly utilized in mine tunnel supporting engineering. In 60's, an anchor rod supporting technology was widely used in railway tunnel, water conservancy, side slope and underground engineering. Since 1970's, the earth anchor rods were widely used in deep foundation pit retaining engineering. Applications of anchorage technologies effectively guarantees the stability of an internal stress field of a rock and soil mass, improves an internal mechanical state of the rock and soil mass, inhibits expansion of plastic zones, transforms a passive supporting to an active supporting and increases the stability of the rock and soil mass and structures. In addition, the application of the anchorage technologies can also reduce the project cost, shorten the construction periods, and reduce the maintenance cost after completion of engineering, and has the advantage of improving durability and the stability with a single step. At present, the geotechnical anchoring technology has been widely applied in the side slope, foundation pit, mine, tunnel and underground engineering, hydraulic structures and anti-floating engineering.

When it comes to a selection of anchoring materials, conditions of surrounding rocks and purposes must be considered in such a manner that an anchoring force is fully obtained along an anchorage length. Necessary requirements for the anchoring material are that the material is easy to fill, the early-term and long-term anchoring force are high enough and has sufficient durability, the material can be glued firmly to a gluing layer of a basic body and a rebar needing anchorage and is easy to build, economic benefits are considerable, etc. The conventional anchoring materials mainly comprise mortar, cement, resin, etc. Although the conventional cement anchoring material in the world is widely utilized in engineering practices, there are still some problems therein such as complex processing of water-contained cement volume, high costs, inconvenient transportation and storage, and installation needing mechanical agitation. A quality of the supporting with an immersed cement volume is lowered and wastes arises because most of additives added in the cement are deliquescent materials, the additives accelerates moisture and metamorphism of the cement, and thus shortens storage periods, lowers performance and even loses efficacy. Additionally, the conventional cement anchoring material in the world utilizes a fixed composition and mixture ratio, and adjustments of a gelation time and strength at scene freely is difficult, therefore, the material can not adapt to changeable characteristics of the geotechnical engineering. While application of a resin bonded anchor is limited because the resin material is poisonous, flammable, easy to aging, and high in price.

In recent years, in order to improve mechanical properties of grout, various modified materials have been developed or introduced for the anchorage, most of the modified materials belong to the category of modified cement mortar. In fact, mixing ordinary cement mortar grout with the modified materials can not change the essence of water reactions, if water is involved, shrinkage after drying happens, anti-seismic and anti-crack capabilities are not sufficient and an improvement of the anchoring force is limited. With rapid developments of the pit foundation, tunnel and side slope engineering, conditions of the rock and soil mass for anchorage engineering are more and more complex and varied, engineering standards are stricter and stricter, and demands for anchorage performance are higher and higher. The conventional anchoring materials like cement mortar are difficult to adapt to requirements of the development of the anchorage technology because of the limited anchoring force, mediocre mechanical performance and insufficient deformation ability. Therefore, the development of a new material without the water reaction has important relevance on improving anchorage effects, widening application fields of the anchorage, and meeting requirements of the complex conditions of the rock and soil mass.

A polymer grouting technology is a foundation reinforcing technology rapidly developed in 1970's. The technology enhances the foundation and filling hollows by grouting a polymer materials into the foundation and taking advantage of a characteristic that the polymer materials expands and solidifies rapidly after chemical reaction happens. At present, the polymer grouting technology is mainly utilized in foundation reinforcements of industrial and civil construction and road maintenance. The inventor combines a non-water reacted two-component expansive polymer grouting material with the anchorage technology according to development requirements of foundation, tunnel and side slope supporting anchorage and deficiencies of the conventional anchoring technology in China as well as provides a new polymer grouting anchorage technology. The innovation has not been reported.

SUMMARY OF THE PRESENT INVENTION

The present invention provides a method for rapid, safe, lightweight and high strength polymer grouting according to development requirements of foundation, tunnel and side slope supporting anchorage and deficiencies of a conventional anchoring technology in China. By taking advantage of the present invention, an anchoring material and a rod body are well consolidated with a rock and soil mass around, the present invention provided a safe, advanced, economic and practical new method for foundation pit, tunnel, side slope supporting, and especially for collapsible loess not suitable for utilizing cement grout as a anchor rod material and a soil expanding with water.

In view of the above, an object of the present invention is to provide:

a grouting method for anchoring with polymer, comprising steps of:

a) processing a rod body, wherein the rod body is straightened, derusted and preserved at first, and then raw materials are cut, holders are welded and centring holders are provided every 0.5 m~2 m on the rod body according to design requirements;

b) tying up a geotextile bag and grouting tubes on the anchoring rod body, wherein the geotextile bag and the grouting tubes are tied up on an end of the rod body, a bottom of the geotextile bag is provided on a border of an anchorage section and a free section when the geotextile bag is tied; a detachable grout inputting valve is mounted on an entrance of the grouting tube, wherein a connector between the grouting tube and a grout injector is fastened and sealed by a tube hoop; the grouting tubes comprises a first grouting tube which is a hole sealing grouting tube, and has an exit thereof provided in the geotextile bag, and a second grouting tube which is an anchoring grouting tube, and has an exit thereof provided at a bottom of a hole;

c) drilling holes, wherein the holes are drilled on positions needing supporting according to a design; and d) grouting polymer, comprising:

I. hole sealing grouting, wherein a two-component expansive polymer grouting material is injected into the geotextile bag with an injection device, the two-component expansive polymer expands and solidifies rapidly after a chemical reaction happens in such a manner that the holes are sealed; and II. anchoring grouting, wherein the grouting tube is inserted into the holes deeply in such a manner that the holes are filled with the polymer grouting material from a bottom of an anchorage section to a top of the anchorage section in the holes and the polymer grouting material is solidified, the polymer grouting material expands to compact soils around a tube wall for being fully intergraded with a rock (or soil) mass and forming a polymer anchoring structure.

After the step d), an anchoring unit is mounted, specifically comprising steps of:

a) selecting a tensioning device according to the material of the anchoring rod body and a value of a locking force;

b) constructing a concrete cushion cap; and c) mounting a pedestal and the anchoring unit, wherein a tensioning operation is presented after strength of the concrete of the cushion cap meets a design strength; the tensioning operation is presented according to a design tensioning speed; a pretensioning operation is presented twice before the real tensioning operation is presented, wherein a tensioning force is 10%~20% of a design tensioning force; a real tensioning load is added step by step, a locking operation is presented when the real tensioning load has been maintained for 15 min and decreases to a locking load.

A non-water reacted two-component expansive flexurane polymer material is the anchoring material utilized in the present invention, when compared to the water reacted polymer material, the non-water reacted polymer material has an obvious characteristic of self expanding. When compared to the conventional grouting anchoring material, the presented polymer material has advantages of:

1. a low density, wherein in engineering applications, the density of the polymer material changes between 200 $Kg/m^3$ and 300 $Kg/m^3$ without shrinking, and an additional stress caused by a reinforcement is low;

2. a quick construction and no maintenance needed, wherein the polymer material has a high chemical reaction rate, and about 90% of strength of the material are formed 15 min after the reaction with little disturbance on the construction;

3. a high expanding speed of the material in reacting, wherein a volume of the material in a solid state can be 10~20 times of a volume of the material in a liquid state in such a manner that a sufficient expanding force is generated, wherein the polymer material in the solid state has a sufficient mechanical property;

4. a small caliber of the grouting tube with no structure damage;

5. a low permeability coefficient of the material with a sufficient water-proofing performance; and 6. a sufficient durability and stability, wherein the material in the solid state is capable of not decomposing or rotting after immersed in water for a long time, and thus doesn't pollute environments.

The polymer grouting technology is applied on geotechnical anchorage, the expansive polymer material has an obvious compacting effect on soil, and is capable of increasing a friction force between the grout and a base; the water-proofing polymer material is an impermeable material for the steel rod body, and is of benefit to anti-corrosion and durability of the rod body; the polymer material has high strength, and is conducive to improving a maximum bearing load of each the anchor rod; a solidifying time of the polymer material is short and no maintenance is needed in such a manner that construction periods are shortened.

Therefore, when compared to the conventional anchorage technology, the present invention has advantages of:

1. a sufficient adaptability; wherein the technology is not only adaptable to the ordinary rock and soil mass, but also adaptable to the construction on collapsible loess not suitable for utilizing the cement grout as the anchor material and the soil expanding with the water;

2. the construction with non-water reaction; wherein dry and shrinkage are not happened to the polymer material after the non-water reaction happens in such a manner that anti-seismic and anti-crack capabilities of the polymer material is sufficient, a volume expanding rate of the polymer material is high, a shape of the anchoring structure is plump and the holes are fully filled, and the polymer material after the non-water reaction is especially adaptable to anchorage engineering of the collapsible loess and the soils expanding with the water;

3. the high strength; wherein the polymer grouting material is fully intergraded with the rocks and soils around, and a root-shaped structure with strong bond is formed, the anchoring force of the polymer material is almost doubled when compared to the anchoring force of a cement anchoring material under same conditions;

4. fast strength increase and convenient construction; wherein the hole drilling, the hole sealing and the grouting of the polymer anchoring nod are presented continuously, a series of polymer grouting equipments is adaptable to the anchorage engineering and emergency repairs of the large, medium and small tunnels, the foundation pits as well as the side slopes, and the construction is convenient; about 90% of the strength are formed 15 min after the reaction and no maintenance is needed, and the present invention is especially useful in the various engineering of anchoring supporting in the emergency repairs;

5. being economic; wherein when compared to the conventional geotechnical anchorage technology, the anchoring force of each the polymer anchoring rod is high, a procedure of the polymer anchoring rod is simple, and steel materials and labors are saved while costs are saved by more than 50%; and 6. the high durability; wherein the polymer grouting material has stable performance, no pollution, high flexibility, the strong bond with the rock and soil mass, a consistent deflection, the low permeability coefficient and a sufficient anti-corrosion effect on the rebar as a water-proofing layer.

These and other objectives, features, and advantages of the present invention will become apparent from the following detailed description, the accompanying drawings, and the appended claims.

DETAILED DESCRIPTION OF THE PREFERRED EMBODIMENT

Figure 1:
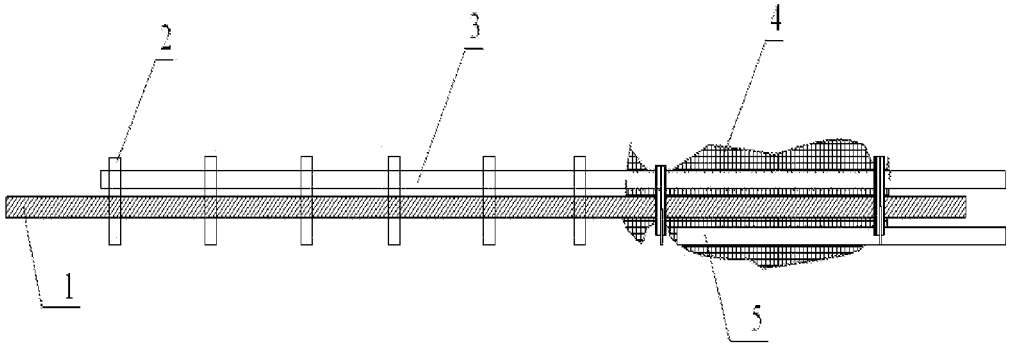
FIG. 1 is a structure sketch of a polymer anchoring rod according to a preferred embodiment of the present invention.
Figure 2:
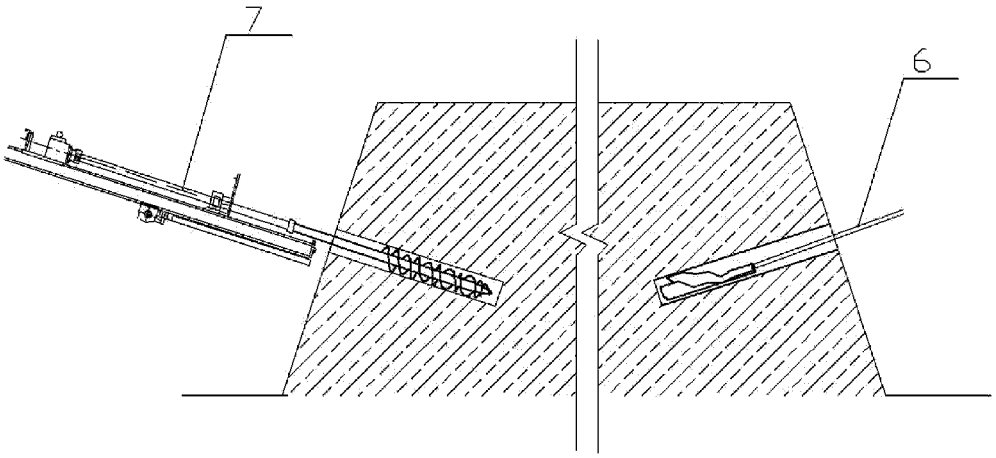
FIG. 2 is a schematic drawing of a hole drilling construction according to the preferred embodiment of the present invention.
Figure 3:
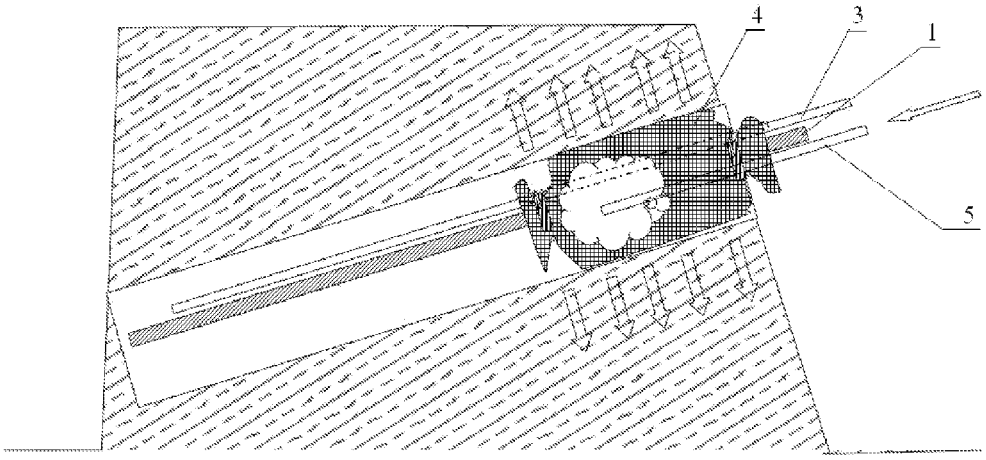
FIG. 3 is a schematic drawing of hole sealing grouting of a geotextile bag and the polymer anchoring rod according to the preferred embodiment of the present invention.
Figure 4:
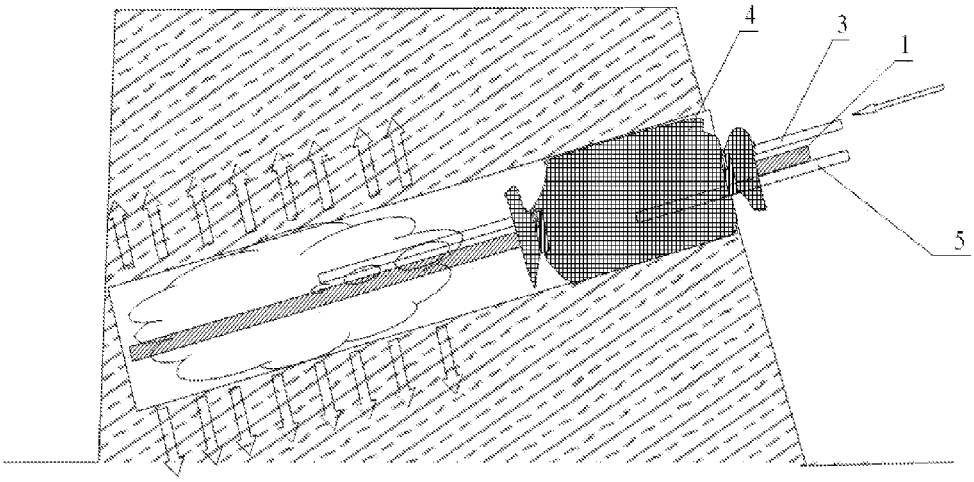
FIG. 4 is a schematic drawing of anchoring grouting of the polymer anchoring rod according to the preferred embodiment of the present invention.

Referring to the drawings, the present invention is further illustrated:

a grouting method for anchoring with polymer comprises steps of:

a) processing a rod body, wherein a material of a rod body 1 is a rebar, a steel cable or other anchoring materials; wherein the rod body 1 is straightened, derusted and preserved at first, dirt such as oil and soils should be kept away from the rod body 1; raw materials are cut by an abrasive saw or a cutting machine and holders are welded according to design requirements, and centring holders 2 are provided every 0.5 m~2 m on the rod body 1, the centring holders 2 may be provided every 0.5 m, 1 m, 1.5 m, 2 m or any length between 0.5 m~2 m;

b) tying up a geotextile bag and grouting tubes on the anchoring rod body 1, wherein the geotextile bag 4 and the grouting tubes are tied up on an end of the rod body 1, a bottom of the geotextile bag 4 is provided on a border of an anchorage section and a free section when the geotextile bag 4 is tied; a detachable grout inputting valve is mounted on an entrance of the grouting tube, wherein a connector between the grouting tube and a grout injector is fastened and sealed by a tube hoop; the grouting tubes comprises a first grouting tube which is a hole sealing grouting tube 5, and has an exit thereof provided in the geotextile bag 4, and a second grouting tube which is an anchoring grouting tube 3, and has an exit thereof provided at a bottom of a hole; the step b) is illustrated in the FIG. 1;

c) drilling holes, wherein the holes are drilled on foundation pits, tunnels and side slopes needing supporting according to the design, wherein the holes are drilled on soil foundation pits, tunnels and side slopes by a Luoyang shovel 6 and drilled on rocks by a drilling tool 7; the step c) is illustrated in the FIG. 3; and d) grouting polymer, wherein the grouting tube is extended into the holes deeply in such a manner that the holes are filled with the polymer grouting material from a bottom of an anchorage section to a top of the anchorage section in the holes and the polymer grouting material is solidified, the polymer grouting material expands to compact soils around a tube wall for being fully intergraded with a rock and soil mass and forming a polymer anchoring structure 9; the step d) is illustrated in the FIG. 4.

Figure 5:
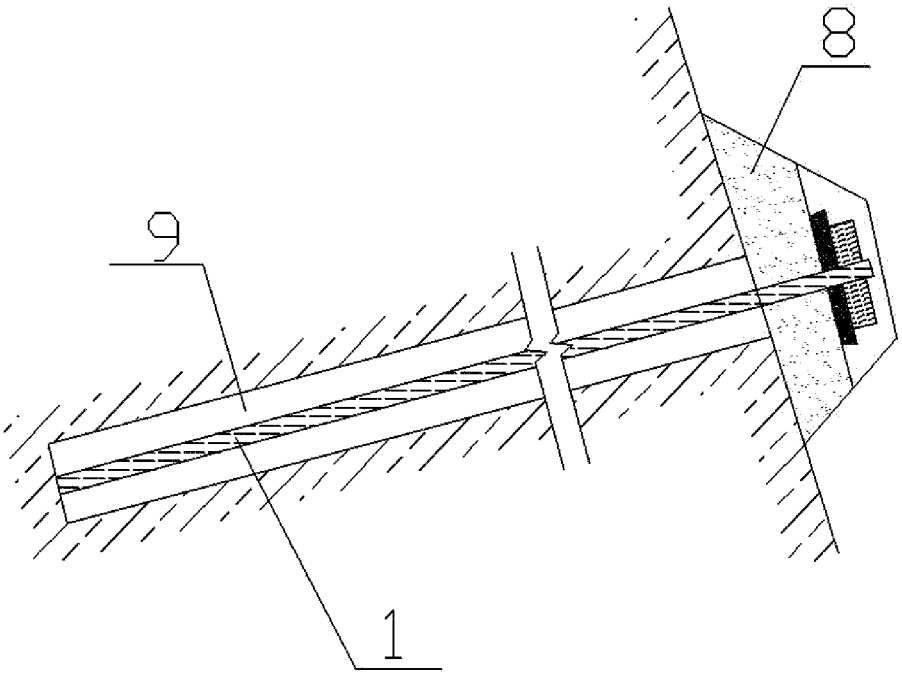
FIG. 5 is a schematic sketch of tensioning of a prestressed anchor rod according to the preferred embodiment of the present invention.

If the rod body 1 needs to be prestressed, an anchoring unit such as an anchoring plate is mounted for a tensioning operation and a locking operation, specifically comprising steps of:

a) selecting a tensioning device according to the material of the anchoring rod body 1 and a value of a locking force;

b) constructing a concrete cushion cap 8 by a conventional method; and c) mounting a pedestal and the anchoring unit, wherein a tensioning operation is presented after a strength of the concrete of the cushion cap 8 meets a design strength; the tensioning operation is presented according to a design tensioning speed; a pretensioning operation is presented twice before the real tensioning operation is presented, wherein a tensioning force is 10%~20% of a design tensioning force; a real tensioning load is added step by step, a locking operation is presented when the real tensioning load has been maintained for 15 min and decreases to a locking load; the step c) is illustrated in the FIG. 5.

What is claimed is:

1. A method for anchoring with polymer grouting, comprising steps of:

1) processing a rod body;

2) tying up a grouting tool on the anchoring rod body, wherein the grouting tool is tied up on an end of the rod body, the grouting tool comprises a hole sealing grouting unit, and an anchoring grouting unit;

3) drilling holes, wherein the holes are drilled on positions needing supporting according to a design, and the rod body is provided in the hole;

4) grouting for sealing the hole, wherein a two-component expanding polymer grouting material is injected through the hole sealing unit with an injection device, the two-component expanding polymer expands and solidifies rapidly after a chemical reaction happens in such a manner that the holes are sealed; and 5) grouting for anchoring, wherein the polymer grouting material is injected through the anchoring grouting unit with the injection device, the polymer grouting material expands to compact soils around a tube wall for being fully intergraded with a rock or soil mass and forming a polymer anchoring structure;

wherein after the step 5), an anchoring unit is mounted, specifically comprising steps of:

a) selecting a tensioning device according to the material of the anchoring rod body and a value of a locking force;

b) constructing a concrete cushion cap; and c) mounting a pedestal and the anchoring unit, wherein a tensioning operation is presented after strength of the concrete of the cushion cap meets a design strength; the tensioning operation is presented according to a design tensioning speed; a pretensioning operation is presented twice before the real tensioning operation is presented, wherein a tensioning force is 10%-20% of a design tensioning force; a real tensioning load is added step by step, a locking operation is presented when the real tensioning load has been maintained for 15 min and decreases to a locking load.

* * * * *